United States Patent [19]

Mankins et al.

[11] Patent Number: 4,587,096

[45] Date of Patent: May 6, 1986

[54] CANLESS METHOD FOR HOT WORKING GAS ATOMIZED POWDERS

[75] Inventors: William L. Mankins; Lindy J. Curtis; Gene A. Stewart, all of Huntington, W. Va.

[73] Assignee: Inco Alloys International, Inc., Huntington, W. Va.

[21] Appl. No.: 737,278

[22] Filed: May 23, 1985

[51] Int. Cl.[4] ..... B22F 3/26

[52] U.S. Cl. ..... 419/27; 419/28; 419/29; 419/31; 419/32; 419/36; 419/37; 419/38; 419/44; 419/54; 419/55; 419/58; 419/60

[58] Field of Search ..... 419/26, 27, 28, 29, 419/30, 31, 32, 35, 36, 37, 38, 44, 54, 55, 56, 57, 58, 60, 64, 65, 66

[56] References Cited

U.S. PATENT DOCUMENTS

| | | | |
|---|---|---|---|
| 3,549,357 | 12/1970 | Osborne | 75/208 |
| 3,740,215 | 6/1973 | Burk et al. | 75/208 |
| 3,798,740 | 3/1974 | Kirk | 29/420.5 |
| 3,859,086 | 1/1975 | Church et al. | 419/30 |
| 4,062,678 | 12/1977 | Dreyer et al. | 419/32 |
| 4,140,528 | 2/1979 | Hebeisen et al. | 419/30 |
| 4,391,772 | 7/1983 | Bonnor et al. | 419/37 |

*Primary Examiner*—Stephen J. Lechert, Jr.

*Attorney, Agent, or Firm*—Edward A. Steen; Raymond J. Kenny

[57] ABSTRACT

A canless method for hot working a nickel-base gas atomized alloy powder. The powder is blended with nickel powder, consolidated and sintered to a sufficient green strength. The surface of the resultant form is sealed to create an oxygen impervious layer so as to prevent oxidation therein. The sealed surface, in a sense, acts as a can. The form is then reheated and hot worked.

11 Claims, 4 Drawing Figures

CANLESS METHOD FOR HOT WORKING GAS ATOMIZED POWDERS

TECHNICAL FIELD

The instant invention relates to the art of metal forming in general and more particularly to a method for extruding pre-alloyed, gas atomized metallic powders without the necessity of a can.

BACKGROUND ART

Powder metallurgical processes are well known techniques for producing metal articles in forms that otherwise are difficult to manufacture. Moreover, by selectively blending the alloying materials before the thermomechanical processing ("TMP") steps are undertaken, the physical and chemical characteristics of the ultimate alloy can be controlled.

Of the various methods for manufacturing shaped articles, the canning process is the most common. Briefly, the metallic powders (elemental or pre-alloyed) are introduced into a mild steel can which is sealed under vacuum or in an non-oxidizing atmosphere. The can is then hot worked to form a near net shape. The can is mechanically or chemically removed.

The difficulty here is that the use of a can is involved and requires additional steps and expense. The disadvantages of the can are: (1) the cost of manufacturing the can, (2) the process of adding the powder to the can and evacuating it (or otherwise treating it) to prevent the powder from oxidizing during subsequent heating steps, and (3) the removal of the can (the decanning operation) from the product.

Powder metallurgy techniques frequently involve hot working as a means for bringing consolidated metallic bodies to near hundred percent density. As stated beforehand, hot working and heating of powders must be conducted in a non-oxidizing atmosphere to prevent oxidation. Oxidation must be avoided since it will limit the density of the final product and, simultaneously, deleteriously affect its properties. Due to the relatively large surface area of the individual particles and the tortuous paths therebetween, powders are easily prone to debilitating oxidation. Accordingly, the powder is placed in a can (or if in a hot isostatic press-an elastic bladder) and treated.

Gas atomized powders compound the problem even further since they are clean (that is, devoid of impurities that, in conventional powders, act as "glue") and are generally spherical in shape. These powders are not cold compactable and hot compaction processes add appreciably to product cost. Spheres do not compact well since there are no irregular surface occlusions (as in conventional powders) to grab and lock onto.

It is desirable to develop a method to produce a billet made from gas atomized powders that may be extruded without the use of a can while simultaneously eliminating the problems associated with oxidation.

Representative references relating to the instant art include: U.S. Pat. No. 3,549,357 in which iron and iron-base alloys are tumbled with a number of elements to coat a sintered object; U.S. Pat. No. 3,798,740 in which a consolidated metal powder is coated with glass prior to extrusion; and U.S. Pat. No. 3,740,215 in which consolidated metal powders are surface sealed and oxidized prior to extrusion.

SUMMARY OF THE INVENTION

There is provided a canless method for hot working a nickel-base alloy billet. The gas atomized alloy powder, blended with additional nickel powder, is compacted to about 60% theoretical density. The compact is sintered in a non-oxidizing atmosphere. The surface of the compact is sealed to reduce oxygen diffusion therein, resintered and then hot worked (40% or more).

PREFERRED MODE FOR CARRYING OUT THE INVENTION

Figure 1:
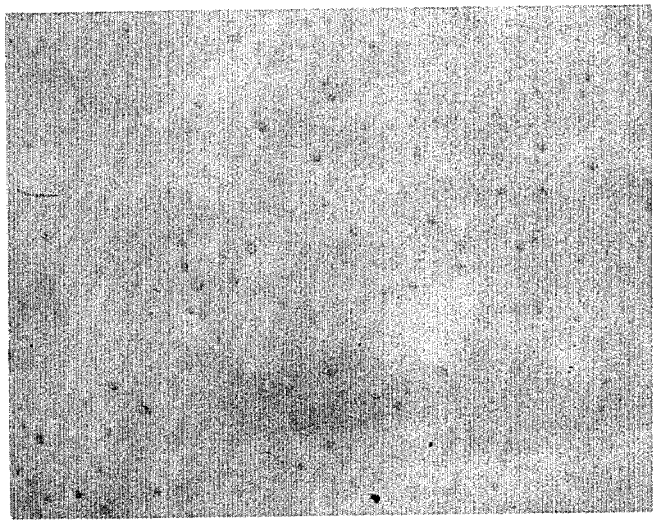
FIGS. 1 and 4 are microphotographs of a billet not treated in accordance with the invention.

For a multiplicity of reasons (size of powder particles, powder shape, cleanliness of the powder, etc.) it is oftentimes difficult or impossible to achieve near 100% density in consolidated powder compacts unless the powder is contained in a body impervious to the sintering atmosphere and subjected to hot working while at the sintering temperature.

In order to reduce costs and eliminate the need for a can the following process was developed. The process approaches 100% theoretical density without treating the powder in a protective container.

Pre-alloyed, gas atomized nickel-base powders are first blended with additional nickel powder and compacted either by gravity packing the resultant powder in a container (pipe, slab, box, etc.) or by mixing the resultant powder with an appropriate binder, and then sintered in a hydrogen atmosphere to obtain the desired green strength for ease of handling. The object is then subjected to a surface sealing operation, optionally in the additional presence of nickel powder. The sealed object is resintered (in an non-oxidizing atmosphere) and then hot worked in the usual manner to obtain the maximum density.

The details of the process are developed more fully below.

The pre-alloyed, nickel-base, gas atomized powders are blended together in a known manner to form the alloy composition desired. Additional nickel powder is added to the pre-alloyed powder.

The quantity of the additional nickel powder may range from about ten percent to about fifty percent of the total nickel content of the alloy. It is preferred to use dilute pre-alloyed nickel powder for reasons which will be explained hereinafter.

The resulting powder mixture is consolidated in any known fashion. It is preferred to either gravity pack a container (such as a pipe) to achieve maximum cold densification (about 60% theoretical density) or mix the powder with a suitable binder (Natrosol ®, Lucite ®, etc.) and extrude or hydrostatially compress the powder to obtain the desired densification. Paradoxically it should be noted that since gas atomized powders are so clean and generally spherical are not readily cold compacted (as distinguished from elemental or water atomized powders). Therefore, in order to obtain adequate green strength, the powder should be gravity packed or subjected to a mechanical consolidation operation.

The object is then either removed from the container or, if treated with a binder, first subjected to a binder burnout operation. If burnout is utilized, the object is subjected to a brief heating and cooling operation in an non-oxidizing atmosphere (vacuum, inert or reducing) to drive off the binder and prevent oxidation from occurring.

In any event, the powder is sintered for about 2–8 hours at approximately 2100°–2200° F. (1150°–1205° C.) in a hydrogen atmosphere and then allowed to cool. The additional nickel powder in the object sinters more quickly than the alloy powder itself, thus allowing a faster sintering time with the attendant savings in energy and time costs. In other words, the addition of nickel powder allows the object to achieve the desired maximum intermediate green strength sooner than an alloy powder without the additional nickel. In addition, the use of reducing hydrogen in this step is preferred over, say, argon or nitrogen, since hydrogen is, on average two to three times cheaper than argon. Moreover, when utilizing nickel-base alloys containing titanium, chromium, molybdenum etc., nitrogen tends to be a nitride former in such a matrix. This is to be avoided because nitride inclusions tend to debase the desired characteristics of the ultimate alloy. Additionally, hydrogen also reduces surface oxides and aids in sintering by increasing surface activation.

The object is then subjected to a surface sealing operation. The previously described sintering step provides adequate strength to the object for subsequent handling required by the sealing operation. By sealing the surface of the object, it becomes largely impervious to oxygen penetration that would otherwise occur from final sintering and hot working. Final sintering can also be accomplished by heating the object before the required hot working operation.

This surface sealing step mimics the results of the canning process since both operations deny entry of oxygen into the object. By eliminating the can (and the associated steps that accompany the canning operation) increased economies may be achieved.

Surface sealing may be accomplished by work hardening (cold working) the surface or otherwise forming a barrier between the object and the atmosphere. A simple coating operation is considered insufficient since the surface pores must be thoroughly sealed. Sealing may be accomplished by surface planishing, machining (such as knurling), nickel plating, grit blasting, peening, flame or plasma spraying, induction heating, laser impingement, etc.

The sealed object is resintered which is essentially a heating operation to bring the object to its hot working temperature. The heating conditions are about 2100°–2200° F. (1150°–1205° C.) for a time sufficient to bring the object up to temperature. A vacuum, inert or reducing atmosphere is again employed in order to forestall oxidation.

The hot workpiece is then hot worked (extruded, forged, rolled, etc.) to complete the densification process.

The above process may be used for the production of nickel-base tubing, rod, flats or any other desired mill form.

A non-limiting example is presented below. The canless procedure results in a near 100% dense powder product formed from a gas atomized metallic powder.

EXAMPLE

Step 1—A blend of dilute (26% Ni) argon atomized INCOLOY alloy 825 and INCO Type 123 powder (16.5% of total blend weight) was blended in a blender with a intensifier bar for 30 minutes. INCOLOY (a trademark of the Inco family of companies) alloy 825 is an alloy primarily made from nickel (38–46%), chromium (19.5–23.5%), molybdenum (2.5–3.5%), copper (1.5%–3%) and iron (balance) and is especially useful in aggressively corrosive environments. INCO (a trademark of the Inco family of companies) Type 123 Nickel Powder is essentially pure nickel powder of uniform particle size and structure with an irregular spikey surface.

Step 2—The blended powder was gravity packed into two 3½ inch (8.9 cm) schedule 40 pipes which were previously pickled on the internal diameters and heated and coated with a mold release agent consisting of a slurry of alumina and water.

Step 3—After drying the pipes, the two molds were filled with the blended powder and charged into a sand sealed retort, purged with nitrogen until the oxygen was 0.4% maximum and sintered under hydrogen at 2200° F. (1204° C.) for 8 hours.

Step 4—The sintered billets were stripped from the molds and one billet was placed in a ball mill containing 9/16 inch (3.8 cm) diameter steel balls and tumbled at low revolutions per minute (rpm) for two hours. An air environment at ambient temperature was used. The speed was then increased to thirty-four rpms and run for four hours. This produced a surface sealed billet (A). Nickel powder may be added to the charge, if desired to further assist the sealing operation.

Step 5—The surface sealed billet A was removed from the ball mill, cut into two lengths (A1 and A2) approximately 15 inches (38 cm) long and ball peened on the cut surfaces to seal the ends. The non-surfaced sealed billet (B) was also cut into two lengths (B1 and B2).

Step 6—Billet A1 and billet B1 were heated at 2150° F. (1177° C.) for two hours in a non-oxidizing atmosphere (argon) and upset in an extrusion press. These billets were cooled and lathe turned to the 3½ inch (8.9 cm) container dimensions and extruded at 9 inch (23 cm) per second after heating for an additional two hours in argon. Both billets were successfully extruded to 1 inch (2.5 cm) diameter and 48 inches (122 cm) long. Hot tearing occurred. Extrusion may be carried out in either a non-oxidizing environment or in an oxidizing environment.

Step 7—Billet A2 and billet B2 were extruded without upsetting after heating at 2150° F. (1177° C.) for two hours in argon. Billet B2 was extruded to 1 inch (2.5 cm) diameter and approximately 48 inches (122 cm) long. Unfortunately billet A2 was only extruded to a 1 inch (2.5 cm) diameter and 8–9 inches (20–23 cm) long form due to a loss of pressure on the press.

The following observations were made. (No oil lubrication was used due to the porous nature of the material.)

1. Billet B1 (upset+extruded=not surface conditioned): Excellent overall—small areas observed where lubrication appeared poor or non-existent.

2. Billet A1 (upset+extruded—surface conditioned): Good surface on last 25 inches (63.5 cm)—first 23 inches (58.4 cm) apparently not lubricated properly.

3. Billet B2 (extruded—not surface conditioned): First 12 inches (30.5 cm) good surface—balance of rod showed evidence of poor lubrication.

4. Billet A2 (extruded—surface conditioned): Excellent surface condition.

A review of the microphotographs (FIGS. 1–4) reveals the efficacy of the instant invention. All Figures are in the as-extruded condition.

FIG. 1, taken at 160 power, is a microphotograph of a polished transverse center section of billet B1. Oxide inclusions are clearly visible and numerous.

Figure 2:
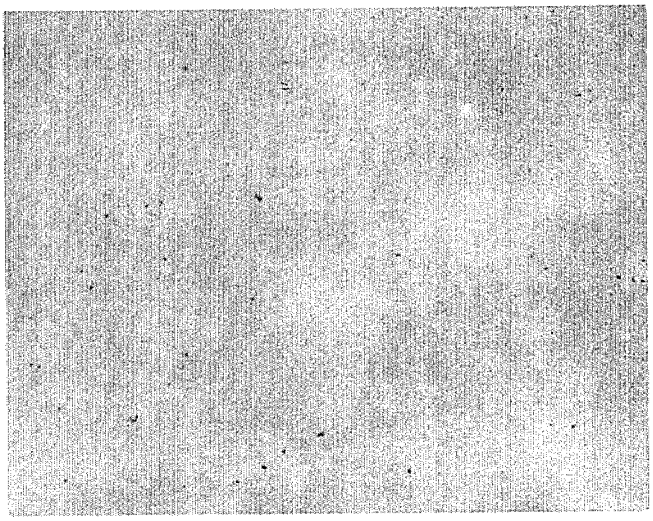
FIGS. 2 and 3 are microphotographs of a billet treated in accordance with the invention.

FIG. 2, also taken at 160 power, is a microphotograph of a polished transverse center section of billet A1. The oxide level is substantially less than what is shown in FIG. 1.

Figure 3:
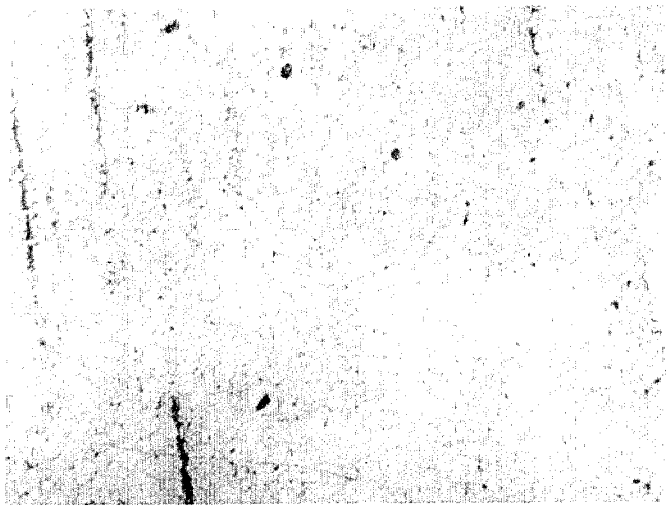

FIG. 3, taken at 500 power, is a microphotograph of an etched (in nital) transverse edge section of billet A1. Sealed grain boundaries are clearly visible.

Figure 4:
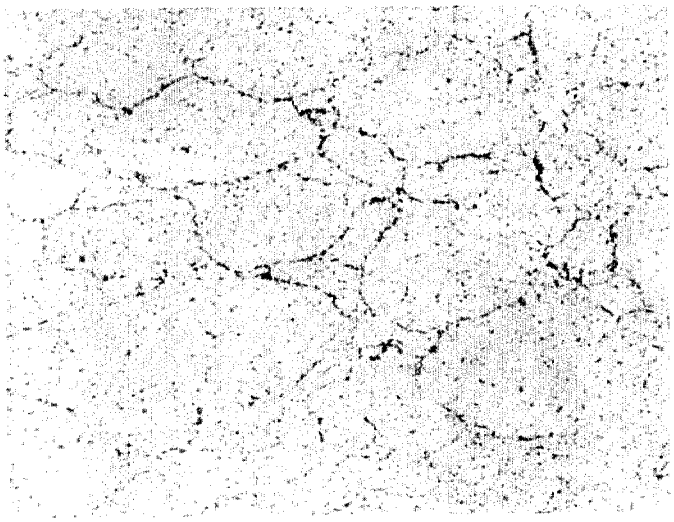

FIG. 4 also taken at 500 power is a microphotograph of an etched (in nital transverse center location of billet B1. Although FIGS. 3 and 4 are not, strictly speaking direct comparisons, it should be apparent that oxide inclusions are more numerous even in the center of billet B1 than on the edge of billet A1. The apparently larger grain boundaries are the original powder particles comprising the alloy.

Chemical analysis (see below) support the proposition that sealing the gas atomized billet with the nickel powder addition results in low oxygen inclusions. Note also the higher nitrogen level in billets B1 and B2.

CHEMICAL ANALYSIS (WT. %) OF EXTRUDED CANLESS BILLET

| | INCOLOY alloy 825 Range (Nominal) | B1 and B2 | A1 and A2 |
|---|---|---|---|
| C | 0.01–0.05 | 0.039 | 0.038 |
| Mn | 0.60–1.0 | 0.37 | 0.38 |
| Fe | Bal | 32.74 | 32.55 |
| S | 0.008 | 0.0018 | 0.0019 |
| Si | 0.30 | 0.014 | 0.012 |
| Cu | 1.5–3.0 | 1.64 | 1.61 |
| Ni | 38.0–46.0 | 37.9 | 38.3 |
| Cr | 21.5–23.5 | 22.95 | 22.68 |
| Al | 0.10 max | 0.11 | 0.11 |
| Ti | 0.60–1.20 | 0.92 | 0.92 |
| Mo | 2.5–3.5 | 3.37 | 3.35 |
| N | — | 0.16 | 0.006 |
| O | — | 0.079 | 0.034 |
| B | 0.003–0.006 | 0.0015 | 0.001 |
| P | 0.20 | 0.001 | 0.001 |

Note:
Tramp analysis on billets A and B
Pb—<0.0005, Sn—<0.002, Zn<0.001,
Ag—<0.0002
Bi—<0.0001, Sb—<0.001, As<0.005

Of the enumerated methods for sealing the billet, the use of a ball mill appears to be easiest to employ in practice. The addition of nickel powder to the ball charge is believed to increase the sealing effect of the operation. The nickel powder is an integral constituent of the compact with the dual purpose of augmenting the gas atomized alloy composition as well as an aid in mechanically sealing the surface of the billet as it is literally smeared into the surface pores. A ball milled surface is estimated to be about 0.005–0.01 inch (0.13 mm–0.25 mm) deep.

It is preferred to utilize dilute, pre-alloyed nickel powder in conjunction with the additional nickel powder for a number of reasons. Dilute powder, with the additional nickel powder, allows the irregular shape of the additional nickel powder particles to operate as a mechanical locking bond between the particles comprising the pre-alloyed powder. In addition, the dilute powder allows for the use of a wider range of pre-alloyed powder sizes. They need not be as small as otherwise would be required. Moreover, the additional nickel is softer than the pre-alloyed powder. Since it is more deformable, the nickel helps seal the surface of the pre-alloyed powder during the sealing operation.

Although it is preferred to cause the first sintering step to occur in a hydrogen environment, the ball mill atmosphere may include an inert gas, a vacuum, or even air. As long as the milling times are not extensive, the surface being sealed will protect the object from oxidation.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A canless method for hot working a gas atomized alloy powder having nickel as a major component, the method comprising blending the alloy powder with additional nickel powder, consolidating the resultant powder into a form, sintering the form in a first non-oxidizing environment for a time necessary to achieve sufficient green strength for subsequent handling, sealing the surface of the form to deny oxygen access therein, heating the sealed form to the hot working temperature in a second non-oxidizing environment, and hot working the form.

2. The method according to claim 1 wherein additional nickel powder is brought into contact with the surface of the form during the surface sealing step.

3. The method according to claim 2 wherein the nickel powder is forced into the surface of the form to seal same.

4. The method according to claim 1 wherein the form is tumbled in a ball mill to seal the surface of the object.

5. The method according to claim 1 wherein the form is sintered in a hydrogen containing environment.

6. The method according to claim 1 wherein the sealing step is conducted in a non-oxidizing environment.

7. The method according to claim 1 wherein the first and second non-oxidizing environments are selected from the group consisting of inert gases, reducing gases, and a vacuum.

8. The method according to claim 1 wherein a binder is introduced to the resultant powder and removed before the form is sintered.

9. The method according to claim 1 wherein the sealing step is conducted in an air containing environment.

10. The method according to claim 1 wherein the form is sintered before the form is hot worked.

11. The method according to claim 1 wherein the additional nickel amounts from about ten per cent to about fifty percent of the total nickel content of the alloy.

* * * * *